US006751893B2

(12) United States Patent
Sullivan et al.

(10) Patent No.: US 6,751,893 B2
(45) Date of Patent: Jun. 22, 2004

(54) NOZZLE MOUNT FOR SOFT EXCAVATION

(75) Inventors: Dennis J. Sullivan, Pella, IA (US); Scott Alan Johnson, Oskaloosa, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 10/233,078

(22) Filed: Aug. 29, 2002

(65) Prior Publication Data

US 2003/0074809 A1 Apr. 24, 2003

Related U.S. Application Data

(63) Continuation-in-part of application No. 09/662,185, filed on Sep. 15, 2000, now Pat. No. 6,446,365.

(51) Int. Cl.[7] ..... E02F 1/00
(52) U.S. Cl. ..... 37/195; 37/905
(58) Field of Search ..... 37/195, 905, 347, 37/317, 323, 335, 336, 344, 466; 299/17

(56) References Cited

U.S. PATENT DOCUMENTS

| | | | | |
|---|---|---|---|---|
| 168,278 A | | 9/1875 | Newton | |
| 223,479 A | | 1/1880 | Case | |
| 552,285 A | | 12/1895 | Gwynne | |
| 1,173,355 A | * | 2/1916 | Jones | 405/248 |
| 1,994,884 A | | 3/1935 | Chew | |
| 2,018,285 A | | 10/1935 | Schweitzer et al. | |
| 2,605,090 A | * | 7/1952 | Jacobsen | 299/8 |
| 2,678,203 A | | 5/1954 | Huff | |
| 2,774,569 A | | 12/1956 | Jacobsen | |
| 3,585,738 A | * | 6/1971 | De Koning | 37/318 |
| 3,585,740 A | | 6/1971 | Koning | |
| RE27,316 E | | 3/1972 | Elenburg | |
| 3,916,634 A | * | 11/1975 | Woodruff | 405/248 |
| 3,975,842 A | * | 8/1976 | Andreae | 37/322 |
| 4,819,347 A | * | 4/1989 | Lofgren | 37/344 |
| 4,936,031 A | * | 6/1990 | Briggs et al. | 37/347 |
| 4,991,321 A | * | 2/1991 | Artzberger | 37/309 |
| 5,016,717 A | | 5/1991 | Simons et al. | |
| 5,284,215 A | | 2/1994 | Tibbitts | |
| 5,291,957 A | | 3/1994 | Curlett | |
| 5,299,370 A | | 4/1994 | Gyori et al. | |
| 5,361,855 A | | 11/1994 | Schuermann et al. | |
| 5,408,766 A | | 4/1995 | Pobihushchy | |
| 5,603,171 A | * | 2/1997 | Steinkuhler | 37/195 |
| 5,860,232 A | | 1/1999 | Nathenson et al. | |
| 5,887,667 A | | 3/1999 | Van Zante et al. | |
| 6,000,151 A | | 12/1999 | Hayes | |

(List continued on next page.)

FOREIGN PATENT DOCUMENTS

| | | |
|---|---|---|
| DE | 1 484 730 | 6/1969 |
| DE | 1 963 720 | 7/1970 |
| IT | 696876 | 10/1965 |
| JP | 4-327687 A | 11/1992 |

OTHER PUBLICATIONS

"E550 & E800 Evacuator[SM] Vacuum Systems", *Vermeer* (2–page flyer, *circa* Sep. 27, 1999).
"E550 Vacuum Excavation System", *Vermeer* (2–page flyer, *circa* Sep. 27, 1999).
"Jet–Vacs", Ring–O–Matic Manufacturing Co., Inc., http://www.ring–o–matic.com/jetvcs.htm, updated Oct. 9, 2000, pp. 1–2.
"Potholing for excavation damage prevention", Vacuum Source Inc., http://www.vacsource.com/potholing.htm, updated Apr. 30, 2000, pp. 1–2.

*Primary Examiner*—Victor Batson
(74) *Attorney, Agent, or Firm*—Merchant & Gould P.C.

(57) ABSTRACT

An excavation wand including a vacuum tube is disclosed herein. The vacuum tube includes a side wall defining at least one air relief opening adjacent a distal end of the vacuum tube. The excavation wand also includes at least one nozzle for directing excavation fluid through the air relief opening.

22 Claims, 5 Drawing Sheets

U.S. PATENT DOCUMENTS 6,202,330 B1 3/2001 Bolton
6,231,270 B1 * 5/2001 Cacossa ..... 405/248
6,273,512 B1 8/2001 Rajewski
6,446,365 B1 9/2002 Sullivan et al.
6,470,605 B1 10/2002 Gilman et al.
6,499,239 B1 * 12/2002 Van Berk et al. ..... 37/314

* cited by examiner

NOZZLE MOUNT FOR SOFT EXCAVATION

CROSS-REFERENCE TO RELATED APPLICATIONS

This application is a continuation-in-part of U.S. patent application Ser. No. 09/662,185 filed Sep. 15, 2000 now U.S. Pat. No. 6,446,365.

FIELD OF THE INVENTION

The present invention relates to excavation devices. Specifically, the present invention relates to a nozzle mount for a hydraulic excavation device for use in soft drilling applications.

BACKGROUND OF THE INVENTION

Existing buried gas, electric, water, telephone, and sewer utility lines are in constant need of repair and replacement. Laying new service lines in areas where existing lines are already buried is complicated by the risk of damaging existing lines during excavation.

For instance, when excavation work must be done in a right-of-way containing a fiber optic cable, it is often desirable to accurately determine the location of the fiber optic cable so that the excavator can avoid damaging it. However, the exact location of a cable buried between manholes can be difficult to determine. Earth movement and settling may have shifted the cable from its original location and render it difficult to locate. Furthermore, the absence of ferrous metals and current-carrying conductive wires from a fiber optic cable can preclude or at least minimize the suitability of magnetic and current-detecting devices. Thus, locating buried fiber optic cables often requires physically exposing them. In this manner their locations can be determined with relative precision. Between the manholes the cable right-of-way is typically "potholed" by excavating at predetermined intervals to expose the buried cable. If only the cable location is desired, a large opening is generally unnecessary. Potholing may be accomplished with hand tools, machines, or both. However, since hand tools are relatively slow and equipment use is attended by a risk of cable damage, both methods have their drawbacks.

The use of mechanical excavation devices such as backhoes, augers, or even shovels threaten to damage undetected buried lines. "Soft" excavation devices use liquid or pneumatic cutting actions in order to prevent damage to underground lines. Devices known in the field are shown in U.S. Pat. Nos. 5,887,667 and 5,860,232. These references disclose an alternative method of excavating each of which has advantages and disadvantages. Typically, these types of excavation, as compared to more conventional methods of mechanical excavation, require higher energy use per volume of material excavated, and may be slower than the conventional excavation. Some devices such as the device shown in U.S. Pat. No. 5,291,957 to Curlett include fluid excavation with mechanical drilling. To the extent that they rely on mechanical means for cutting, grinding or breaking up the soil, such devices still threaten to damage buried objects. There is significant need for improved soft excavation devices that will not damage existing underground lines during use.

SUMMARY OF THE INVENTION

One aspect of the present invention is directed to a nozzle mount assembly for use in soft drilling employing liquid jet nozzles. The assembly includes a straight vacuum tube of electrically nonconductive material, having proximal and distal ends, and a plurality of nozzle ports disposed around the vacuum tube. The vacuum tube defines an air relief slot near its distal end.

Another aspect of the present invention relates to a wear ring disposed on the distal end of the vacuum tube.

A further aspect of the present invention relates to angling the nozzle ports such that at least one nozzle port is angled toward the inside of the vacuum tube and at least one nozzle port is angled away from the vacuum tube.

Another aspect of the present invention relates to configuring a nozzle port to be angled or located to direct fluid through the air relief slot. The invention permits a nozzle to be located outside the vacuum tube yet direct fluid to contact material located within the vacuum tube or alternatively for the nozzle can be located within the vacuum tube yet allowing the ejected fluid to contact material on the outside of the vacuum tube.

Yet another aspect of the present invention relates to a manifold for use with a vacuum tube in soft excavation. The manifold is configured to be disposed around the vacuum tube. The manifold includes a plurality of nozzle ports, at least one of which is inwardly angled and at least one of which is outwardly angled. The manifold further defines an air trough separating two of the nozzle ports.

Another aspect of the present invention relates to the use of multiple nozzles. The nozzles are mounted in a manner that a complete circular area will be impacted by the ejected fluid as the tool is rotated through an angle of less than 180 degrees.

Another aspect of the present invention relates to a mechanical device that aids in reducing the size of the excavated material, located within the vacuum tube.

DETAILED DESCRIPTION OF THE PREFERRED EMBODIMENT

Figure 3:
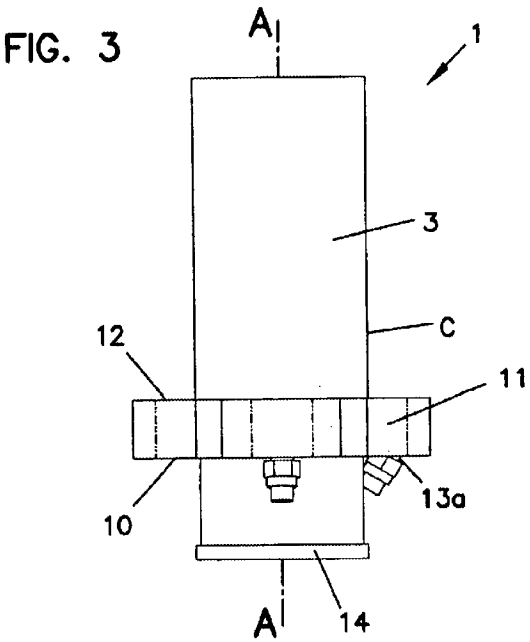
FIG. 3 shows a top view of the nozzle mount assembly of FIG. 1.
Figure 4:
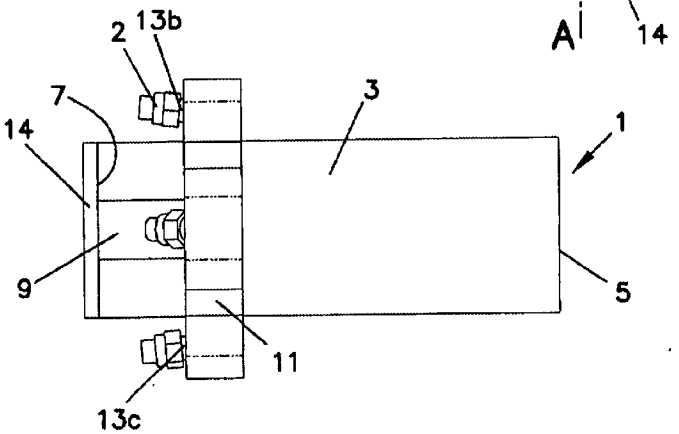
FIG. 4 shows a side view of the nozzle mount assembly of FIG. 1.
Figure 1:
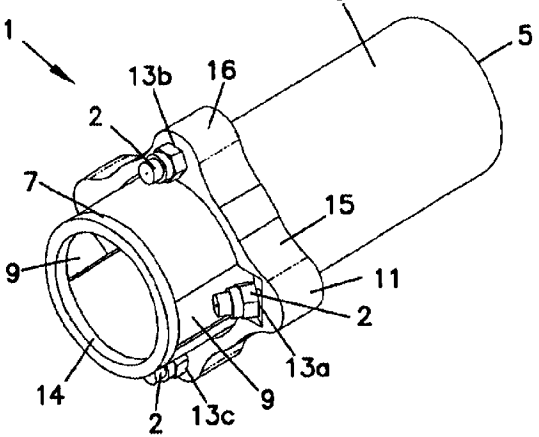
FIG. 1 shows a perspective view of a nozzle mount assembly according to the present invention.
Figure 2:
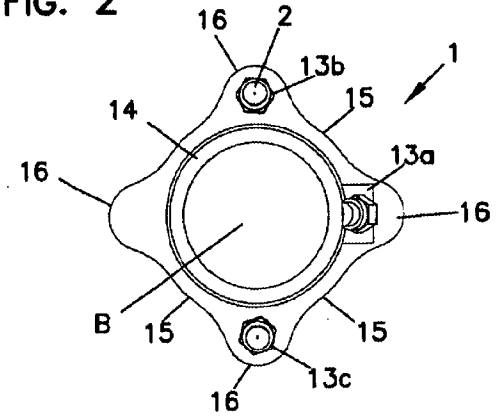
FIG. 2 shows a distal end view of the nozzle mount assembly of FIG. 1.

Referring now to the several drawing figures in which identical elements are numbered identically, a nozzle mount assembly 1 according to the present invention is shown. The nozzle mount assembly is meant to be coupled to both a fluid pressure system and a vacuum system. The fluid pressure system conveys water or other fluid under pressure to the nozzle mount assembly 1. Nozzles 2 mounted in the nozzle mount assembly 1 then direct the pressurized fluid into soil-cutting streams. The system pressure and nozzles are sized to produce a soil-cutting stream that is efficient at cutting and dislodging soils, yet not aggressive enough to damage utilities. The streams of fluid cut away and or dislodge the soil, clay, and rocks while the vacuum system evacuates the fluid mixed with soil debris, clay and rocks away from the hole being excavated. The assembly 1 may be included as part of an excavator wand to be held and manually operated by a single worker, or, alternatively the assembly 1 may be incorporated into a larger excavation vehicle having a hydraulically operated excavation arm onto which the assembly 1 may be mounted.

The nozzle mount assembly 1 includes a vacuum tube 3 and a blunt wear ring 14. The vacuum tube 3 has a proximal end 5 and a distal end 7. The proximal end 5 of the vacuum tube 3 may configured to be coupled to a vacuum wand which couples the vacuum tube 3 to the vacuum system. The vacuum tube 3 is characterized by an interior B, an exterior C, and a center axis (line A—A). The vacuum wand to which the vacuum tube is coupled may comprise a nonconductive shaft such as a PVC pipe in order to resist electrical conductance through the tube if a power line is struck by the assembly 1. Rather than as a funnel, the vacuum tube 3 is preferably shaped as a straight section of pipe (i.e. the pipe has a constant inner diameter) to prevent plugging associated with contraction of the vacuum tube's inner diameter.

The nozzles 2 are mounted near the distal end of the vacuum tube 3. One embodiment includes a manifold 11 that is disposed around the exterior of the vacuum tube 3. The manifold 11 can be connected to the tube by any number of techniques such as welding, press-fit, etc. The manifold 11 is "star-shaped," defining a plurality of radially-extending, rounded nozzle port regions 16 or protuberances spaced around an outer perimeter of the manifold. The nozzle port regions define angled nozzle ports 13*a*, 13*b* and 13*c* which are configured with threadings to accept standard high pressure nozzles 2, such as No. 3.5 sized nozzles. As is known in the art, "No. 3.5 nozzles" refers to the flow through the nozzle at a given fluid pressure. A No. 3.5 nozzle has an aperture having a diameter of approximately 0.044 inches. At 40 psi of water pressure, 0.35 gallons per minute will flow through a No. 3.5 nozzle. Such nozzles may be obtained from Spraying Systems Co. in Wheaton, Ill. The nozzle port regions 16 of the manifold 11 protect the nozzles 2 from scraping against the side of the excavated hole.

The nozzles 2 are received into the nozzle ports 13*a–c* from a distal side 10 of the manifold 11. Each nozzle port 13*a–c* receives a fluid hose or tubing from a proximal side 12 of the manifold 11. Therefore, the nozzle ports 13*a–c* couple fluid hoses or other tubing to each nozzle 2. In the preferred embodiment shown in the figures, nozzle ports 13*a–c* allow the use of three individual lengths of hose. By separating the fluid flow into individual streams carried in individual hoses, the flow of fluid to the nozzles 2 preferably is kept as laminar as possible. This streamline effect produces a concentrated spray from each nozzle 2 which is optimal for soil cutting. Also, placing the nozzle ports 13*a–c* and nozzles 2 around the outside of the vacuum tube 3, instead of inside the vacuum tube 3, minimizes soil collection around the nozzles during the vacuuming process.

Nozzle port 13*a* is inwardly angled relative to the central axis A-A so that the stream of fluid exiting the nozzle mounted therein will be directed toward the interior of the vacuum tube 3 and will carve away the soil adjacent the distal end 7 of the vacuum tube 3. In certain embodiments, the port 13*a* is angled 10 to 70 degrees relative to the central axis A—A of the tube 3. In the preferred embodiment shown in the figures, nozzle port 13*a* is angled 30 degrees toward the center axis of the vacuum tube away from a direction parallel to the center axis.

Nozzle ports 13*b* and 13*c* are each outwardly angled relative to the central axis A-A so that the stream of fluid exiting the nozzles 2 mounted therein will be directed away from the vacuum tube 3 toward the sidewall of the hole being excavated. Thus, upon rotation of the tube 3 about its center axis A-A by the operator, the stream from the outwardly angled nozzle cuts a hole in the soil that is bigger than the diameter of the vacuum tube 3. In certain embodiments, the nozzle ports 13*b* and 13*c* are angled up to 40 degrees relative to the central axis A—A of the tube 3. The angle of the nozzles, and their effective cutting characteristics, as influenced by the geometry of the nozzles 2 and the fluid pressure and flow, combined with the type of soil being cut will determine the diameter of the hole being excavated. In a preferred embodiment, the nozzle ports 13*b* and 13*c* are angled 5 degrees relative to the central axis A—A. By so directing the fluid streams, a hole will be excavated which is larger in diameter than the nozzle mount assembly 1. Carving a hole larger in diameter than the excavation assembly 1 allows for the assembly 1 to be easily rotated as the assembly 1 digs down. In addition, the larger excavation hole permits air to reach the distal end of the assembly 1.

During operation, the assembly 1 is rotated so that a fluid stream is directed against all sides of the hole being excavated. This may be accomplished by rotating the assembly 1 back and forth approximately 180 degrees or by continuously rotating the assembly 1 in the same direction.

Preferably, 0° spray pattern nozzles 2 are used to provide optimum cutting action. In the preferred embodiment shown in the figures, No. 3.5 orifice nozzles are used at water pressures around 750 psi. This provides for suitable soil cutting capability without damaging underground utilities, cables, or other buried items. The No. 3.5 orifice nozzles are also large enough for adequate self-cleaning and reduced nozzle plugging. The manifold 11 may be positioned a distance away from the distal end of the assembly (e.g. 1 to 5 inches) to protect the nozzles from abrasive wear and to protect buried lines from unnecessary contact with the fluid streams. The manifold 11 of the present invention permits the use of fixed place nozzles which are less expensive and require less maintenance than rotary type nozzles. The size of the nozzle orifices may be varied so long as the flow rate of fluid through the orifices is appropriately adjusted to prevent damage to buried utilities and lines.

On the distal end 7 of the vacuum tube 3 is disposed a blunt wear ring 14. The wear ring 14 provides a blunt edge to prevent any mechanical cutting action so that buried cables or other lines are not damaged as the assembly 1 digs down. In addition, the wear ring 14 may also give the assembly 1 a smaller diameter at the its most distal end so that the assembly 1 produces higher pick-up velocity and suction power. The wear ring 14 also reduces wear on the distal end 7 of the vacuum tube 3 due to abrasion from rocks and soil. The wear ring 14 provides a blunt end to the assembly, being at least 1.5 times and preferably more than 2 times greater in thickness than the wall of the vacuum tube 3.

The distal end of the vacuum tube 3 is designed to optimize the excavating action of the air flow that results from the vacuum applied to the vacuum tube during excavation. Preferably, there are various air flow paths provided, each with a different effect on the excavating characteristics of the assembly. At a minimum, there is a flow path defined by the open end of the vacuum tube 3. Additionally, there is preferably a secondary flow path that is large enough to allow a significant air flow rate in the event the end of the vacuum tube 3 is blocked off. In a preferred embodiment, this secondary air flow path is defined by two air relief slots 9 that extend longitudinally along the length of the vacuum tube 3 from its distal end 7 to the manifold 11. The wear ring 14 defines the bottom edge of the slots 9. In one non-limiting embodiment, each of the slots has a width of at least ½ inch to inhibit plugging of the slots.

The wear ring 14 in cooperation with the relief slots 9 may also give the assembly 1 a smaller diameter at its most distal end so that the assembly 1 produces higher pick-up velocity and suction power. This occurs when the assembly 1 is set on the soil such that the wear ring 14 seals off the end of the tube 3. In that occurrence 100% of the air flow is through the air relief slots 9. In prior art devices, any small change in clearance between the soil and the distal end of the vacuum tube has a significant effect on the resulting air velocity. The addition of air relief slots 9, however, provides for more consistent air velocity. Additionally, in prior art devices, the air flow occurs around the complete circumference of the vacuum tube. An advantage of this invention is that the cooperation of the wear ring 14 and the air relief slots 9 results in a controlled flow of air producing multiple more effective excavation points, defined by the air relief slots 9.

In certain embodiments, at least one air relief slot 9 is aligned with nozzle port 13*a* so that its corresponding nozzle 2 is adapted to direct fluid inwardly through the slot 9 to excavate material directly beneath the distal end 7 of the tube 3. Air allowed into the vacuum tube 3, through the air relief slots 9, assists in carrying particles of soil that were excavated directly below the distal end of the tube 3 up the length of the assembly 1. Additionally when the operator raises the assembly 1 such that the wear ring 14 is not resting on the soil, air will flow around the circumference of the wear ring 14 and more aggressively transport this same material.

The soil that is being excavated from the annular space 20 defined by the outer diameter of the tube 3 and the effective cutting radius of nozzles 2 mounted in ports 13*b* & 13*c* is transported by the air flow around the circumference of the wear ring 14 and/or through the air relief slots 9.

The volume of soil being excavated from directly below the distal end 7 of the tube 3 may be equal to or slightly less than the volume of soil being excavated from the annular space 20. The volume of material being excavated is directly proportional to the cross sectional areas of the spaces. The cross sectional areas are directly proportional to the square of the diameters. As a result, the effectiveness of the excavating mechanism for the soil in the annular space 20 may need to be equal to or greater than that for the soils directly below the distal end 7 of the tube 3. When the wear ring is resting on the soil and 100% of the air flow is directed through the air relief slots 9, the excavating mechanism for the annular space 20 is optimized. When the wear ring 14 is lifted off the soil, and air can flow around the wear ring 14, the excavating mechanism for directly below the distal end 7 of the tube 3 is optimized.

The manifold 11 also defines air troughs 15 spaced around the outer perimeter of the manifold 11 between the nozzle port regions 16. The air troughs 15 are deep enough to allow sufficient air flow between the vacuum tube 3 and a sidewall 22 of the hole being excavated to prevent plugging. For a vacuum tube 3 roughly three inches in diameter, the air troughs 15 are preferably at least ¾ of an inch deep measured radially from a point along the trough nearest to the central axis of the vacuum tube 3 to a point which is the same distance from the center of the vacuum tube 3 as an outermost tip of a nozzle port region 16 of the manifold 11.

Air allowed into the vacuum tube 3 assists in carrying particles of soil up the length of the assembly 1. The air relief slots 9 and air troughs 15 also minimize plugging of the vacuum tube 3 typically associated with use in soils having large clay content or other sticky conditions. The assembly 1 may operate to draw air, fluid, and debris radially through the air relief slots 9 (i.e., in a radial direction relative to the central axis A—A) even when the open distal end 7 of the tube 3 defined by the bottom edge of the wear ring 14 is completely sealed. The air relief slots 9 and the air troughs 15 ease removal of the assembly 1 from the excavated hole by preventing the assembly 1 from sucking to the bottom of the hole.

The process for potholing thus includes:

1) initially resting the wear ring 14 on the ground, thereby sealing off the distal end 7 of the tube 3;
2) applying vacuum to the proximal end of the vacuum tube 3, thereby inducing air flow through the air relief slots 9 effectively creating two material excavating points as defined by the air relief slots 9;
3) applying fluid flow to nozzles 2 disposed in the nozzle ports 13*a–c*, effectively cutting soils in the center of the vacuum tube 3 with the nozzle in port 13*a* and in the annular space 20 with the nozzles in ports 13*b* and 13*c;*
4) rotating the assembly 1 back and forth through approximately 180 degrees such that the nozzles in ports 13*b* and 13*c* completely cut the soil in the annular space 20 and air relief slots 9 completely excavate that cut soil and material;
5) continuing to excavate the material while a hole is being formed. When the hole is deep enough so that the manifold 11 is in the hole, the air flow will be through the annular space 20 along the length of the vacuum tube 3 at some nominal rate, it will increase around the manifold 11 and nozzle ports due to the reduced cross sectional area through which it may flow;
6) occasionally lifting the assembly 1 such that the wear ring 14 is lifted off the soil so that soils directly below the distal end 7 of the tube are more aggressively excavated; and
7) operating by rotating the assembly 1, allowing the assembly 1 to rest on the soil effectively optimizing the excavation at the air relief slots 9 to remove material from the annular area 20, and occasionally lifting the assembly 1 effectively optimizing the excavation directly below the distal end 7 of the tube 3.

Figure 5:
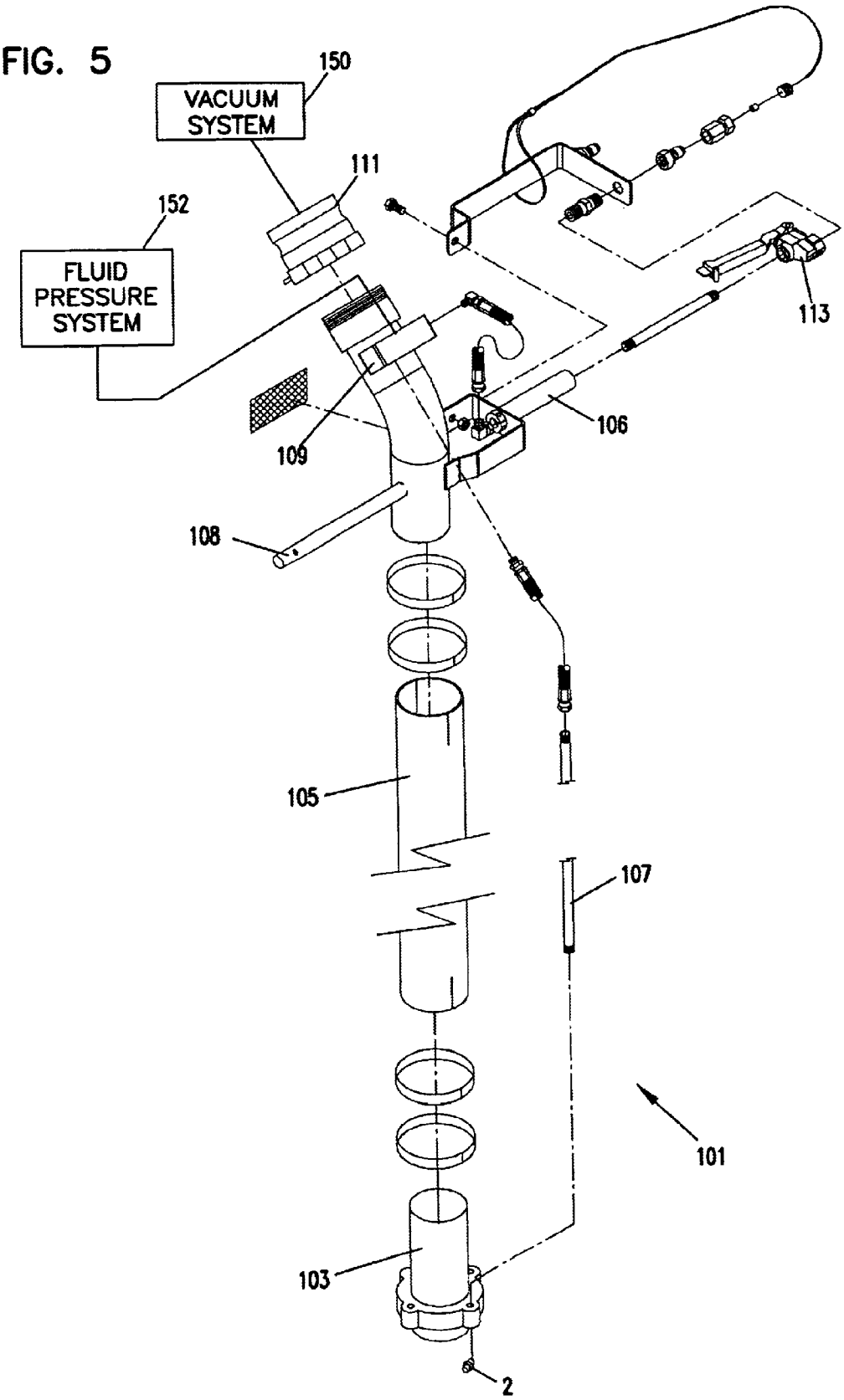
FIG. 5 shows an assembly drawing of an excavator wand system incorporating a nozzle mount in accordance with the principles of the present invention.
Figure 6:
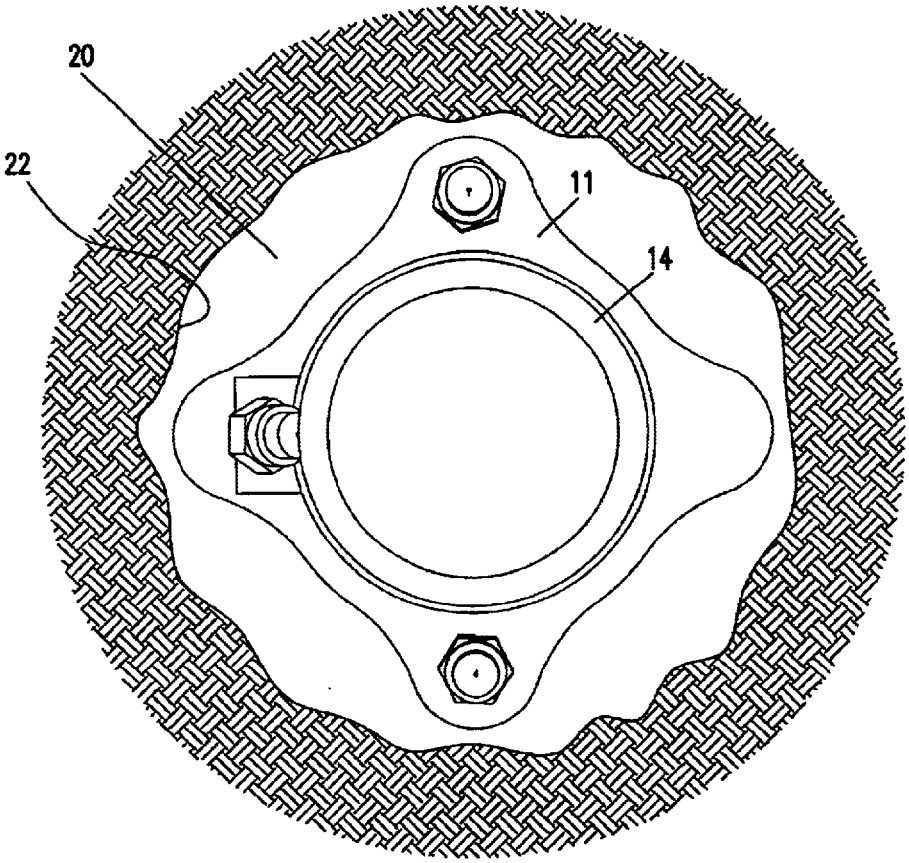
FIG. 6 shows an end view of the nozzle mount assembly of FIG. 1 disposed within a hole being excavated.

FIG. 5 shows an alternative embodiment of the present invention incorporated into an excavator wand 101. The excavator wand 101 includes a nozzle mount assembly 103 embodying the present invention, a vacuum shaft 105, a conduit or hose 107, an upper manifold 109, a vacuum coupling 111, operator handles 106 and 108 and a flow control valve 113. The vacuum coupling 111 couples the vacuum shaft 105 and nozzle mount assembly 103 to a vacuum system 150 for drawing out fluid mixed with soil cuttings and debris from the hole being excavated. In certain embodiments, the vacuum system 150 includes a vacuum and a reservoir for holding excavated material. The upper manifold 109 distributes pressurized fluid from a fluid pressure system 152 (e.g., a pump and a fluid reservoir from which the pump draws fluid) to a plurality of the conduits 107 (only one is shown). Preferably, one conduit is provided for each nozzle in the nozzle mount assembly 103. An operator may control the flow of fluid through the upper manifold by means of the flow control valve 113 incorporated into the operator handle 106. The excavator wand 101 may be used by rotating it generally 180° about its major axis as fluid jets produced by the nozzles in the nozzle mount assembly 103 cut away the soil. The vacuum tube of the nozzle mount assembly 103 and the vacuum shaft 105, powered by the vacuum system, remove soil and fluid from the hole.

Figure 8:
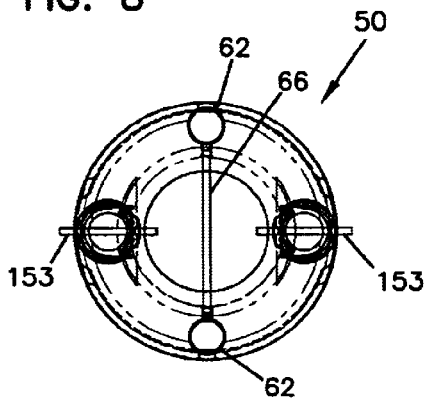
FIG. 8 shows a distal end view of the nozzle mount assembly of FIG. 7.
Figure 9:
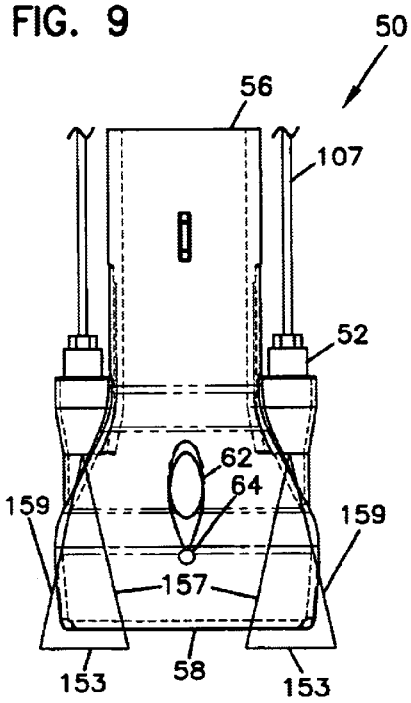
FIG. 9 shows a top view of the nozzle mount assembly of FIG. 7.
Figure 10:
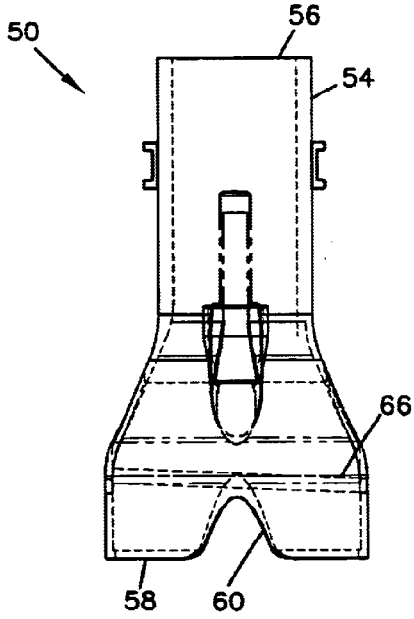
FIG. 10 shows a side view of the nozzle mount assembly of FIG. 7.

FIGS. 8–10 illustrate another embodiment of the invention. In this embodiment the 0 degree nozzles 2 as used in the first embodiment have been replaced by active nozzles 52. The active nozzles 52 eject a steady stream of fluid, similar to the 0 degree nozzles 2. However the spray direction of the stream of fluid is constantly changing. The pattern in which the spray direction changes is defined by the specific nozzle selected. One active nozzle is known as an oscillating nozzle. An example is manufactured by Giant Industries, Inc: the Model 22700 Turbo Laser Nozzle oscillates back and forth along a plane defined between lines 157, 159 shown on FIG. 9. This pattern terminates at a cutting line illustrated as 153 in FIGS. 8 and 9. In other embodiments, rotary nozzles for providing a rotary fan-shape conical cutting volume could be used. The pressure utilized with a 3.5 active nozzle can be up to 2000 psi without damaging underground utilities, cables or other buried items.

Figure 7:
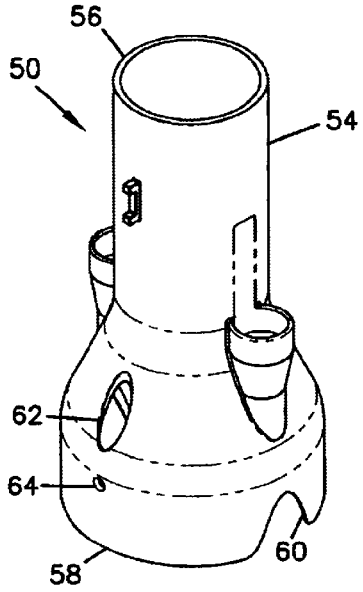
FIG. 7 shows a perspective view of a nozzle mount assembly according to another embodiment of the present invention.

In the embodiment of FIG. 7, the nozzle mount assembly 50 includes a generally cylindrical vacuum tube 54 with a proximal end 56 and a distal end 58. The vacuum tube 54 is enlarged near the distal end 58. The proximal end 56 is configured the same as the proximal end 5 of the first embodiment. The distal end 58 is configured similarly to that of the distal end 7 of the first embodiment. The active nozzles 52 are positioned substantially in-line with the axis of vacuum tube 54 and located such that they are within the radius of the enlarged portion of the vacuum tube 54. In this manner the active nozzles 52 are protected by the vacuum tube 54.

The distal end 58 of vacuum tube 54 further includes bottom air relief slots 60 and upper air relief slots 62. These slots are provided to allow air flow paths maximizing the capacity of the air flow to carry the cuttings. The bottom air relief slots 60 further provide a passage for the fluid stream ejected from active nozzles 52, allowing the fluid stream to cut a hole that is larger in diameter than the enlarged portion of vacuum tube 54. This is illustrated in FIGS. 8 and 9 where the linear area 153 extends outside the radius of the enlarged portion of vacuum tube 54.

Vacuum tube 54 near the distal end 58 further includes aligned holes 64, defining an axis that is perpendicular to the axis of vacuum tube 54. These holes 64 are sized to accept a breaker rod 66 that passes through, and is supported by, holes 64. This breaker rod functions to mechanically break-up soil particles that remain intact as they pass from the distal end 58 to the proximal end 56 of vacuum tube 54.

It will be appreciated that the assembly 50 can be used in the same manner as the previous embodiments to perform potholing operations.

Figure 11:
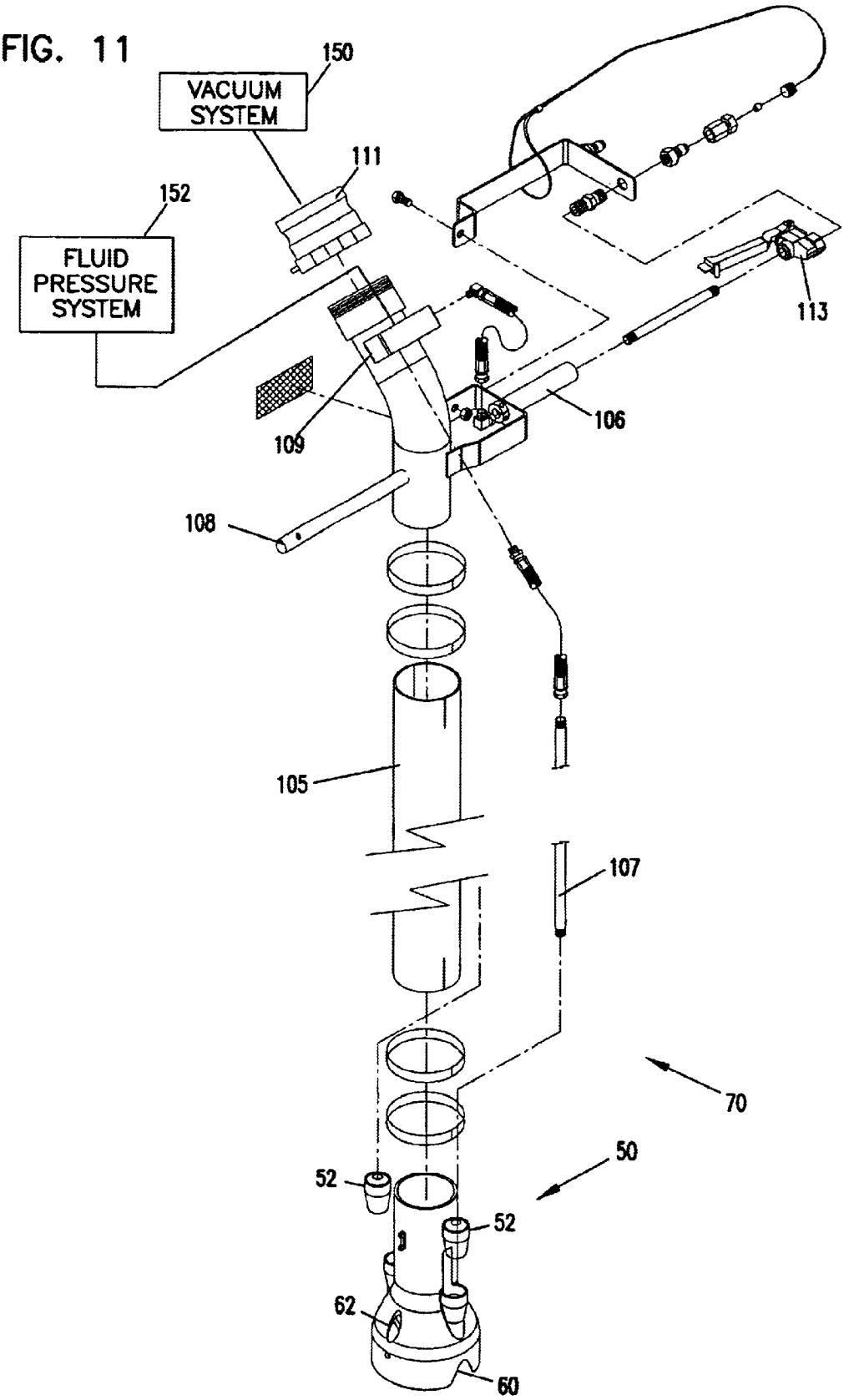
FIG. 11 shows an assembly drawing of an excavator wand system incorporating the nozzle mount of FIG. 7.

FIG. 11 shows an alternative embodiment of an excavator wand 70 utilizing the nozzle mount assembly 50 of FIG. 7. The remaining components of the excavator wand 70 are similar or identical to those of excavator wand 101 in FIG. 5.

The above specification, examples and data provide a description of the invention. Since many embodiments of the invention can be made without departing from the spirit and scope of the invention, the invention resides in the claims hereinafter appended.

What is claimed is:

1. An excavation wand comprising:

a vacuum tube having distal and proximal ends, the vacuum tube defining a central evacuation passage, the distal end of the vacuum tube being open and in fluid communication with the central evacuation passage, and at least one air relief opening in fluid communication with the central evacuation passage and positioned adjacent the distal end of the vacuum tube;

at least one nozzle mounted near the distal end of the vacuum tube;

at least one conduit for providing pressurized fluid to the at least one nozzle; and wherein the nozzle is positioned to direct fluid through the air relief opening.

2. The excavation wand of claim 1, wherein the at least one nozzle comprises an active nozzle.

3. The excavation wand of claim 1, wherein the at least one nozzle is positioned such that the nozzle directs fluid from the inside of the central excavation passage outwardly through the air relief opening.

4. The excavation wand of claim 3, wherein the at least one nozzle is an active nozzle.

5. The excavation wand of claim 3 comprising at least 2 nozzles, each aligned with an air relief opening such that the nozzles direct fluid outwardly through the air relief openings from inside the excavation passage.

6. The excavation wand of claim 1 further comprising a bar that is positioned in the vacuum tube that extends across the central evacuation passage.

7. The excavation wand of claim 6, wherein the bar is positioned adjacent the distal end of the vacuum tube.

8. The excavation wand of claim 1, wherein the nozzle is mounted such the largest dimension from a center axis of the vacuum tube to the outside surface of the nozzle is less than a maximum outer radius of the vacuum tube.

9. An soft excavation system comprising:

a vacuum system;

a fluid pressure system;

a vacuum tube to which the vacuum system applies negative pressure, the vacuum tube including a tube wall defining a central evacuation passage, the vacuum tube having a lowermost end that is enlarged and at least partially open for allowing excavated material to be drawn into the central evacuation passage, and the tube wall defining at least one air relief opening located at least partially above the lowermost end for allowing excavated material to be drawn into the central evacuation passage;

at least one nozzle mounted near the lowermost end of the vacuum tube;

at least one conduit for conveying pressurized fluid from the fluid pressure system to the at least one nozzle;

a flow control valve for controlling the fluid flow provided from the fluid pressure system to the at least one nozzle; and wherein the nozzle is positioned to direct fluid through the air relief opening.

10. The excavation system of claim 9, wherein the nozzle comprises an active nozzle.

11. The excavation system of claim 9, wherein the nozzle is positioned to direct fluid from inside the central excavation passage through the air relief opening such that an effective radius of the fluid exceeds an outer side wall radius of the tube wall.

12. The excavation system of claim 11, comprising at least 2 nozzles, each aligned with an air relief opening such that the effective radius of the fluid exceeds the outer side wall radius.

13. The excavation system of claim 9, further comprising a mechanical device inside the vacuum tube for breaking larger material drawn into the vacuum tube.

14. The excavation wand of claim 9, wherein the nozzle is mounted such that a largest dimension from a central axis of the side wall to an outside surface of the nozzle is less than a maximum outer side wall radius.

15. A nozzle mount assembly for use in soft excavation, the assembly comprising:

a vacuum tube having proximal and distal ends and an evacuation passage, the vacuum tube including an air relief slot in fluid communication with the evacuation passage;

a nozzle port defined by the vacuum tube adjacent the air relief slot; and wherein the nozzle port is positioned to orient a cooperating nozzle such that at least some portion of a fluid ejected from said nozzle will be directed through said air relief slot.

16. The nozzle mount assembly of claim 15, further comprising two nozzle ports.

17. A method of excavating with a soft excavator wand having a nozzle mount assembly, the method comprising:

providing a vacuum tube having proximal and distal ends, the vacuum tube defining an air relief slot near the distal end of the vacuum tube;

providing a two nozzle ports defined by the vacuum tube, the nozzle ports being positioned to orient a cooperating nozzle such that at least some portion of a fluid ejected from the nozzle will be directed through the air relief slot;

placing nozzles in the nozzle ports of the nozzle mount assembly;

directing fluid through the nozzles to cut away soil at an excavation location, the nozzles cutting away soil to form an excavation hole larger in diameter than a diameter of a manifold of the nozzle mount assembly; and drawing air, fluid, and cuttings through the vacuum tube, the air being drawn from between a wall of the excavation hole and the vacuum tube, through air troughs of the manifold, and through the air relief slot of the vacuum tube.

18. A method of excavating with an excavation device including a vacuum tube and a first nozzle, the vacuum tube including a side opening and a bottom opening, the method comprising:

directing pressurized fluid from the first nozzle outwardly from the vacuum tube through the bottom opening to excavate material from beneath the vacuum tube; and directing pressurized fluid from the first nozzle outwardly from the vacuum tube through the side opening to excavate material from along side the vacuum tube.

19. An excavation wand comprising:

a vacuum tube having distal and proximal ends, the vacuum tube defining a central evacuation passage, the distal end of the vacuum tube being open and in fluid communication with the central evacuation passage, and the side wall of the vacuum tube defining at least one air relief opening positioned adjacent the distal end of the vacuum tube;

at least one nozzle mounted near the distal end of the vacuum tube;

at least one conduit for providing pressurized fluid to the at least one nozzle;

wherein the nozzle is positioned to direct fluid through the air relief opening; and a bar positioned in the vacuum tube and extending across the central evacuation passage.

20. The excavation wand of claim 19, wherein the bar is positioned adjacent the distal end of the vacuum tube.

21. The nozzle mount assembly of claim 15, wherein the air relief slot is formed along a bottom edge of the distal end of the vacuum tube.

22. A method of excavating with an excavation device, the method comprising:

providing a vacuum tube including a side opening and a bottom opening, each of the side and bottom openings being in fluid communication with a vacuum tube passage for evacuating material;

directing pressurized fluid outwardly from the vacuum tube through the bottom opening to excavate material from beneath the vacuum tube; and directing pressurized fluid outwardly from the vacuum tube through the side opening to excavate material from along side the vacuum tube.

* * * * *